US005743017A

United States Patent [19]

Dreher et al.

[11] Patent Number: 5,743,017

[45] Date of Patent: Apr. 28, 1998

[54] DEVICE FOR HEATING THE BLADES OF SCISSORS, KNIVES AND THE LIKE

[75] Inventors: Walter Dreher; Hans Kessing, both of Immendingen; Klaus Paulat, Schoenebuerg Schwendi, all of Germany

[73] Assignee: Theracut-Hair-Technik GmbH, Germany

[21] Appl. No.: 626,133

[22] Filed: Apr. 5, 1996

[30] Foreign Application Priority Data

Apr. 12, 1995 [DE] Germany ..... 295 06 308.4

[51] Int. Cl.[6] ..... B26B 13/24

[52] U.S. Cl. ..... 30/140; 219/229

[58] Field of Search ..... 30/140; 606/28; 219/221, 227, 229

[56] References Cited

U.S. PATENT DOCUMENTS

| | | | |
|---|---|---|---|
| 1,083,386 | 1/1914 | Chapman | 30/140 |
| 2,863,036 | 12/1958 | Mitchell et al. | 30/140 |
| 3,024,342 | 3/1962 | Birnbach et al. | 30/140 |
| 3,208,142 | 9/1965 | Osrow | 30/140 |
| 4,516,574 | 5/1985 | Hewes, Jr. | 30/140 |
| 5,046,251 | 9/1991 | Scott | 30/140 |
| 5,309,640 | 5/1994 | Caron | 30/140 |

FOREIGN PATENT DOCUMENTS

| | | | |
|---|---|---|---|
| 1502767 | 11/1967 | France | 30/140 |

OTHER PUBLICATIONS

European Search Report dated Jul. 31, 1996.

*Primary Examiner*—Hwei-Siu Payer

*Attorney, Agent, or Firm*—Stephan A. Pendorf, P.A.

[57] ABSTRACT

A device for heating of the blades of scissors, knives and the like, with heating module comprising an electrical heating strip provided on the metallic blades, connecting conductors for providing current to the heating strip, and a cowling of a synthetic material. The heating module is capable of being fastened on the outer surface of the blade. The heating strip is in thermal conductive contact with the outer surface of the blade, extends over the length of the cutting edge of the blade, and is on its outer surface covered with a cowling of a synthetic material.

15 Claims, 1 Drawing Sheet

DEVICE FOR HEATING THE BLADES OF SCISSORS, KNIVES AND THE LIKE

BACKGROUND OF THE INVENTION

1. Field of the Invention

The invention concerns a device for heating of the blades of scissors, knives and the like, with heating module comprising an electrical heating strip provided on the metallic blades, connecting conductors for providing current to the heating strip, and a cowling of a synthetic material. The heating module is capable of being fastened on the outer surface of the blade. The heating strip is in thermal conductive contact with the outer surface of the blade, extends over the length of the cutting edge of the blade, and is on its outer surface covered with a cowling of a synthetic material.

2. Description of the Related Art

From WO 92/00688 there is known a scissors for the simultaneous cutting and cauterization of hair. In this scissors the blades include recesses, in which a razor blade is seated, on which the cutting edge is formed. In the recess an electrical heating strip is seated, which is thermally insulated from the metallic blade by a thermal insulating material. Thereby it is accomplished, that the electrical heating strip primarily causes heating of the razor blade and only minimally heats the metal blade. The electrical heating strip is connected in series as a resistor, wherein respectively on one of the coupling ends of the heating strip an electrical connector cable of the current supply is coupled, while the respective other end of the heating strip is soldered onto the respective blade and via the metallic blades and the joining bolt through which these are connected are electrically conductively coupled with each other. The current delivery to the heating strip is controlled by a temperature sensor, which is provided between the scissors blades and the razor blade and senses the temperature of the razor blade.

The heated razor blades of this known scissors makes possible the cutting of the hair, wherein the temperature of the razor blade is from 150° C. to 300° C. so that simultaneously a cauterization of the hair tips is accomplished. Because of the recesses in the blades and the therein seated razor blades, an expensive special machining of the scissors is necessary. The current flow through the blades and the connecting bolt makes it necessary to provide the scissors with electrically insulating grip parts.

The invention is concerned with the task of providing a device which has multiple utilities, which is simple in construction and is economical to produce and which lends itself to the heating of those blades of devices as primarily conventionally employed in the trade.

SUMMARY OF THE INVENTION

The invention is achieved by a device for heating of the blades of scissors, knives and the like, with heating module comprising an electrical heating strip provided on the metallic blades, connecting conductors for providing current to the heating strip, and a cowling of a synthetic material. The heating module is capable of being fastened on the outer surface of the blade. The heating strip is in thermal conductive contact with the outer surface of the blade, extends over the length of the cutting edge of the blade, and is on its outer surface covered with a cowling of a synthetic material.

Preferred embodiments of the invention are set forth in the dependent claims.

The device according to the invention can be utilized with devices as conventionally employed in the trade, of which the blades are formed of metal, for example with scissors for the simultaneous cutting and cauterization of the hair, with scissors of the type for thinning out the hair, with razor blades, with disposable razors, etc. With these devices formed in the conventional manner, an electrical heating module is introduced upon the outer surface of the blade. The outer side of the blade and the heating strip are covered by a cowling of a synthetic material, so that the heating strip and the blade are electrically as well as also thermally insulated and no danger exists, that during the use of the device electrically conductive or hot parts are inadvertently contacted. Since the heating strip and the synthetic material of the cowling are substantially mounted outside upon the blade, it follows that the equipping or retrofitting of the device with the heating module is simple and economical.

The heating foil or strip can be provided on the outer side of the blade, so that its own longitudinal edge borders along the cutting edge of the blade, whereby the heat produced by the heating strip primarily is concentrated on the cutting edge side of the heating strip. Thereby it is made possible, to selectively heat the cutting edge of the blade. The heating strip extends itself thereby from the blade tip along the cutting edge of the blade. The cowling is preferably formed of a form stable casing, which is adapted to the outer contour of the blade. The cowling can be secured to the blade in a simple manner with two screws, whereby the heating strip is functionally held and secured between the blade and the cowling.

The means for securing of the cowling and the heating strip is preferably designed to be releasable, so that the cowling and the heating strip can be removed in a simple manner for the cleaning and disinfecting of the device.

The simple attachment and releasability of the cowling and the heating strip make it possible, besides this, to use the same heating module for different devices.

Preferably a temperature sensor is seated in the intermediate area of the heating strip, and serves for the controlling of the current delivery and therewith the amount of heat. The temperature sensor is optimally provided in the area of the greatest warming, so that a reliable operation is achieved.

In order to make the manipulation of the device as comfortable as possible, the attachment circuitry for the heating strip and the temperature sensor is preferably guided along the grip part of the blade and secured on this grip part. For functional reasons the tension relieving part is therefore secured on this grip part and covers and secures the connecting cord. The electrical cord thus does not interfere with the manipulability of the device and at the same time the relieving of tension and the connection of the electrical cord to the heating strip is insured.

In order to secure the connecting electrical cable on the grip part of one scissor part of a scissors, the connecting circuitry of the heating strip and, as the case may be, the temperature sensor of the other grip part must be directed through this first grip part, in order not to interfere with the swivelability of the scissors. For this the connecting circuitry can be guided around about the scissors part to the first grip part. Since these connecting circuits guided around about the scissors part can eventually be disturbed, it is preferred that the connecting bolt connecting the two scissors parts is provided as a hollow bolt and the connecting circuitry of the second scissors part is electrically insulated and guided through this hollow connecting bolt to the grip part of the first scissors part.

BRIEF DESCRIPTION OF THE DRAWINGS

In the following the invention will be described in greater detail by reference to the embodiment shown in the drawing. There is shown FIG. 1 a scissors with a heating module according to the invention, FIG. 2 a cross-section through the blade of the scissors with the heating module, and FIG. 3 the heating strip of the heating module.

DETAILED DESCRIPTION OF THE INVENTION

The scissors is comprised of two scissors parts of steel, which respectively are comprised of the blade 10.1 or as the case may be 10.2 and a grip part 12.1 or as the case may be 12.2. The scissors parts are connected pivotally with each other by means of a connecting bolt 14 constructed as a screw. The connecting bolt 14 is bored through coaxially.

Figure 3:
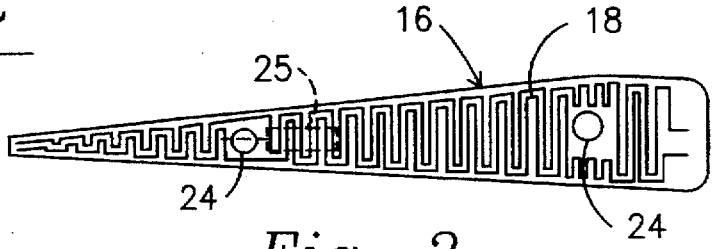

On the outer side of the blade 10.1 and 10.2 there is respectively provided an electrical heating strip 16, as is shown in FIG. 3. The heating strip 16 is comprised of a synthetic material with thereupon provided electric resistance heating strips 18. The heating strip 16 corresponds in its design substantially to that of the design of the outer surface of the blade 10 and is so provided on its outer surface, that the heating strip 16 extends from the tip of the blade 10 to the vicinity of the connecting bolt 14. A longitudinal edge of the heating strip 16 boarders thereby upon the cutting edge 20 of the blade 10. Thereby the heat produced by the heating strip 16 is concentrated upon the area of the cutting edge 20 of the blade 10.

Figure 1:
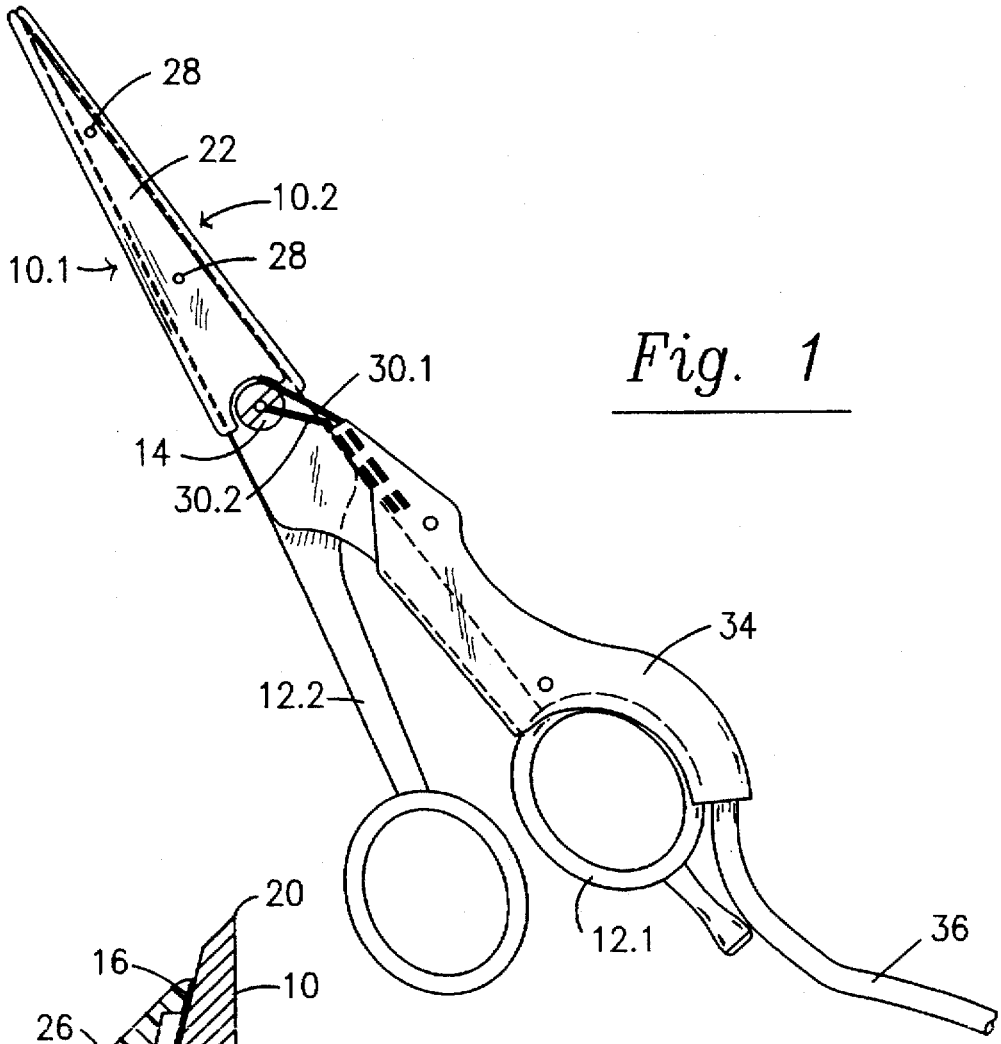
Figure 2:
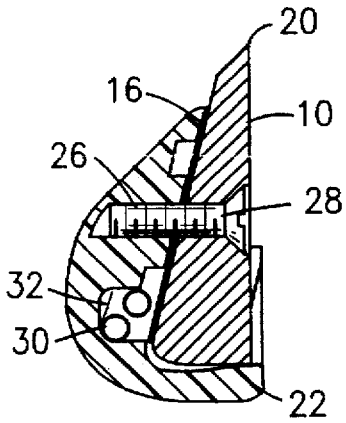

On the outer side of the blade 10.1 and 10.2 there is respectively seated a cowling 22 which is in the form of a stable shell of a synthetic material. The cowling 22 extends in a longitudinal direction over the length of the blade 10 up to the connecting bolt 14. The cowling 22, in cross-sectional profile, has an angular profile, contoured to fit on the one side onto the outer side of the blade 10 and on the other side onto the back edge of the blade 10 opposite to the cutting edge 20, as can be seen in FIG. 2. The cowling 22 covers over the outer side of the blade 10 and the heating strip 16 completely, both in the longitudinal as well as in the breadthwise direction. Likewise the cowling 22 completely covers over the back side of the blade 10 which is opposite the cutting edge 20. Essentially only the cutting edge 20 and the internal surfaces of the blades 10.1 and 10.2 which line in contact with each other are left free of the cowling 22.

For securing of the heating module, comprised of the heating strip 16 and the cowling 22, the blades 10.1 and 10.2 are bored through at points longitudinally distanced on the blade. These boreholes through the blades 10 correspond to matching mounting holes 24 of the heating strip and threaded boreholes 26 of the cowling 22. The boreholes of the blades 10.1 and 10.2 are recessed on their inner surfaces. From the inner side of the blade, screws 28 are introduced in these boreholes, which extend through the holes 24 in the heating strip 16 and are screwed into the threaded boreholes 26 of the cowling 22. In this manner the heating strip 16 and the cowling 22 are releasably secured to the blades 10.1 and 10.2, wherein the threaded boreholes 26 are preferably provided as blind or pocket boreholes, so that the mounting means are not visible from the outside of the cowling 22.

In the heating strip 16 a temperature sensor 25, is provided in the central area, in order to measure the temperature of the blade 10.

For current delivery to the heating strip 16 there are provided interfacing or connecting electrical circuits or conductors 30.1 and 30.2. The connecting electrical conductors 30.1 and 30.2 are guided through notch 32 provided in the inner surface of the cowling 22 to the connectors for the heat resistance strip track 18. The connecting conductors 30.1 of the heating strip 16 and the therewith associated temperature sensor exits on the grip side end of the cowling 22 of the blade 10.1 and are guided along the grip part 12.1 of the scissors part. The connector conductors 30.2 of the heating strip of the other blade 10.2 and the therewith associated temperature sensor exit at the grip side of the cowling 22, are insulated and directed through the axial bore of the connecting bolt 14 and then run likewise along the grip part 12.1 of the other scissors part.

The various connector conductors 30.1 and 30.2 are guided along the outer side of the grip part 12.1 and are there secured and covered by means of a tension relieving part 34. The tension relieving part 34 is a synthetic or plastic covering, which with its U-shaped profile is slid over the outer side of the grip part 12.1 and is frictionally held there. The electrical connecting conductors 30.1 and 30.2 emerge from the tension relieving part 34 and the grip part 12.1 merged as a connector cable 36. The scissors is connected to a current providing source and control unit by means of connector cable 36. By means of the control unit the current provision to the heating strip 16 is regulated according to the temperature as determined by the temperature sensor, so that a temperature is maintained in the blade as established by the control unit.

In accordance with the invention a conventional scissors may be employed. It is necessary only that the blades 10.1 and 10.2 of the scissors are provided with boreholes for the securing of the heating module comprised of the heating strip 16 and the cowling 22. Further, the connecting bolt 14 must be provided with an axial borehole.

The heating strip 16 achieves an optimal heating of the blades 10, wherein the heating area is concentrated essentially on the cutting edge 20 of the blade 10. The cowling 22 prevents an unintended contacting of the heating strip 16 and the heated areas of the blade 10.

What is claimed is:

1. A pair of scissors comprising:

a first scissors part and a second scissors part pivotally connected via a connecting bolt, each of said scissors parts including a blade part and a grip part, said blade part having an outer surface and an inner surface and a longitudinal cutting edge;

wherein a first heating module is secured to said blade part of said first scissors part and a second heating module is secured to said blade part of said second scissors part;

a first electrical heating module and a second electrical heating module each comprising:

an electrical heat strip having an inner surface and an outer surface;

electrical conductors coupled to said heat strip for delivering current to said heat strip; and a cowling of a synthetic material provided on said outer surface of said heat strip and contoured to conform to the outer surface of said blade part to which it is secured;

said electrical heat strip, said electrical conductors, and said cowling forming each said heating module;

wherein said first and second heating modules are secured to said first and second blade parts, respectively, in such a manner that the respective heat strip is in heat conductive contact with the respective outer surface of the blade part, extends along the length of the cutting edge of the blade part, and is covered over on its outer surface by said cowling.

2. A pair of scissors as in claim 1, wherein said connecting bolt connecting said first and said second scissors parts is provided with a coaxial bore hole, and wherein the conductors of the heat strip of the blade part of the second scissors part are insulated and guided through the coaxial bore hole of the connecting bolt of the scissors to the first scissors part.

3. A device for cutting with heat, said device including at least one heating module, said device for cutting comprising:

a blade part and a grip part, said blade part having an outer surface and an inner surface and a longitudinal cutting edge;

said heating module comprising:

an electrical heat strip having an inner surface and an outer surface;

electrical conductors coupled to said heat strip for delivering current to said heat strip; and a cowling of a synthetic material provided on said outer surface of said heat strip and contoured to conform to the outer surface of said blade part;

said electrical heat strip, said electrical conductors, and said cowling forming said heating module;

wherein said heating module is secured to said blade part in such a manner that the heat strip is in heat conductive contact with the outer surface of the blade part, extends along the length of the cutting edge of the blade part, and is covered over on its outer surface by said cowling, and wherein said heat strip is provided with a temperature sensor.

4. A cutting device according to claim 3, wherein said temperature sensor is provided in the central area of the heat strip.

5. A cutting device according to claim 3, wherein said heat strip has a first longitudinal edge and a second longitudinal edge, and is adapted for being provided on the outer surface of said blade part with one of its longitudinal edges bordering on said longitudinal cutting edge of said blade part, and extending up to the tip of the blade part.

6. A cutting device according claim 3, wherein the heat strip adapted for being lodged between said blade part and said cowling.

7. A cutting device according to claim 3, further including means for releasably mounting said cowling and said heat strip on said blade part.

8. A cutting device according to claim 3, wherein said cowling is shaped to conform to the outer surface of said blade part, including a back side of the blade part which lies on the side of the blade part opposite to the cutting edge.

9. A cutting device according to claim 3, wherein the electrical conductors are guided along the grip part.

10. An electrical heating module for heating a blade of a cutting implement, said blade having an outer surface and including a longitudinal cutting edge, said electrical heating module comprising:

an electrical heat strip having an inner surface and an outer surface;

electrical conductors coupled to said heat strip for delivering current to said heat strip; and a cowling of a synthetic material provided on said outer surface of said heat strip and contoured to conform to said outer surface of said blade;

said electrical heat strip, said electrical conductors, and said cowling forming said heating module, wherein said heating module is designed for being secured to said blade in such a manner, that the heat strip is in heat conductive contact with the outer surface of the blade, extends along the length of the cutting edge of the blade, and is covered over on its outer surface by said cowling; and wherein said heat strip is provided with a temperature sensor.

11. An electrical heating module according to claim 10, wherein said temperature sensor is provided in the central area of the heat strip.

12. An electrical heating module according claim 10, wherein the heat strip is adapted for being lodged between said blade and said cowling.

13. An electrical heating module according to claim 10, wherein said cowling is shaped to conform to the outer surface of said blade, including a back side of the blade which lies on the side of the blade opposite to the cutting edge.

14. A combination cutting implement blade and electrical heating module for heating said blade, said blade having an outer surface and including a longitudinal cutting said electrical heating module comprising:

an electrical heat strip having an inner surface and an outer surface;

electrical conductors coupled to said heat strip for delivering current to said heat strip; and a cowling of a synthetic material provided on said outer surface of said heat strip and contoured to conform to said outer surface of said blade;

said electrical heat strip, said electrical conductors, and said cowling forming said heating module, wherein said heating module is designed for being secured to said blade in such a manner, that the heat strip is in heat conductive contact with the outer surface of the blade, extends along the length of the cutting edge of the blade, and is covered over on its outer surface by said cowling, wherein said blade includes a grip part, and wherein the electrical conductors are guided along the grip part of the blade, wherein the conductors secured to the grip part are thereby covered and secured via a tension relieving part adapted for being secured to the grip part.

15. A combination cutting implement and electrical heating module for heating said implement said implement having an outer surface and including a longitudinal cutting edge, said electrical heating module comprising:

an electrical heat strip having an inner surface and an outer surface;

electrical conductors coupled to said heat strip for delivering current to said heat strip; and a cowling of a synthetic material provided on said outer surface of said heat strip and contoured to conform to said outer surface of said implement;

said electrical heat strip, said electrical conductors, and said cowling forming said heating module, wherein said heating module is designed for being secured to said implement in such a manner, that the heat strip is in heat conductive contact with the outer surface of the implement extends along the length of the cutting edge of the implement, and is covered over on its outer surface by said cowling, wherein said implement includes a grip part, and wherein the electrical conductors are guided along the grip part of the implement, and wherein said cutting implement is a pair of scissors having two blade parts, and wherein a heating module is capable of being fastened to each of the two blade parts of the scissors.

* * * * *